US006192597B1

(12) United States Patent
Kahl et al.

(10) Patent No.: US 6,192,597 B1
(45) Date of Patent: Feb. 27, 2001

(54) DEVICE FOR TREATING A FIBROUS PULP WEB AS WELL AS A SEALING DEVICE FOR A DEVICE OF THIS KIND

(75) Inventors: Peter Kahl, Gerstetten; Karl-Heinz Klein, Sontheim; Wolfgang Müller, Giengen; Markus Oechsle, Batholoma; Uwe Joos, Aalen, all of (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 09/061,074

(22) Filed: Apr. 16, 1998

(30) Foreign Application Priority Data

| | | |
|---|---|---|
| Apr. 17, 1997 | (DE) | 197 16 131 |
| Apr. 17, 1997 | (DE) | 297 17 556 U |
| Oct. 1, 1997 | (DE) | 197 43 517 |

(51) Int. Cl.[7] ..... D06F 58/00
(52) U.S. Cl. ..... 34/115; 34/122; 34/124
(58) Field of Search ..... 34/114, 115, 117, 34/120, 122, 124

(56) References Cited

U.S. PATENT DOCUMENTS

| | | | | |
|---|---|---|---|---|
| 4,185,399 | * | 1/1980 | Gladish | 34/120 |
| 4,996,782 | | 3/1991 | Eivola . | |
| 5,341,579 | | 8/1994 | Schiel et al. . | |
| 5,515,619 | | 5/1996 | Kahl et al. . | |
| 5,556,467 | | 9/1996 | Koskinen et al. . | |
| 5,600,897 | | 2/1997 | Sollinger et al. . | |
| 5,735,060 | | 4/1998 | Atzinger et al. . | |
| 5,860,223 | | 1/1999 | Kahl . | |

FOREIGN PATENT DOCUMENTS

| | | |
|---|---|---|
| 2151287 | 12/1995 | (CA) . |
| 2205851 | 8/1972 | (DE) . |
| 984594 | 12/1972 | (DE) . |
| 2405108 | 9/1974 | (DE) . |
| 3034806 | 3/1982 | (DE) . |
| 3346923 | 5/1985 | (DE) . |
| 3910600 | 10/1990 | (DE) . |
| 4014742 | 11/1990 | (DE) . |
| 4314475 | 12/1993 | (DE) . |
| 4336271 | 3/1994 | (DE) . |
| 4340578 | 5/1994 | (DE) . |
| 4401378 | 6/1994 | (DE) . |
| 4420242 | 1/1995 | (DE) . |
| 296 13 809 U | 11/1996 | (DE) . |
| 297 03 627 U | 7/1997 | (DE) . |
| 297 17 556 U | 1/1998 | (DE) . |
| 197 02 605 | 7/1998 | (DE) . |
| 640716 | 3/1995 | (EP) . |
| 2153508 | 8/1985 | (GB) . |

* cited by examiner

*Primary Examiner*—Corrine McDermott
*Assistant Examiner*—Malik N. Drake
(74) *Attorney, Agent, or Firm*—Greenblum & Bernstein, P.L.C.

(57) ABSTRACT

Device for treating a fibrous pulp web that includes at least one support face, which is one of moving and stationary. The fibrous pulp web may be guided over the at least one support face. The device also includes at least one sealing device positioned on a side of the fibrous pulp web facing away from the at least one support face to strip at least a majority of a bordering air layer that entrained by the fibrous pulp web. The at least one sealing device may include a sealing disc that is one of substantially straight and at least partially curved, and that is at least one of elastically formed and resiliently mounted.

39 Claims, 2 Drawing Sheets

DEVICE FOR TREATING A FIBROUS PULP WEB AS WELL AS A SEALING DEVICE FOR A DEVICE OF THIS KIND

CROSS-REFERENCE TO RELATED APPLICATIONS

The present application claims priority under 35 U.S.C. § 119 of German Patent Application No. 197 16 131.6 and, filed on Apr. 17, 1997, and of German Patent Application Nos. 197 43 517 297 17 556.4.3, filed Oct. 1, 1997, the disclosures of which are expressly incorporated by reference herein in their entirety.

BACKGROUND OF THE INVENTION

1. Field of the Invention

The present invention relates to a device for treating a fibrous pulp web, e.g., a paper and/or a cardboard web. The fibrous pulp web may be guided either alone or together with at least one support belt, e.g., a draining belt, press belt, screen (sieve) belt, over at least one support face, which may be moving or stationary. The device may also include at least one sealing device positioned on a side of the fibrous pulp web located opposite the support face to strip away at least the majority of the bordering air layer that is entrained or swept in by the fibrous pulp web and/or support belt.

The present invention also relates to a sealing device that may be utilized in a fibrous pulp treatment device of the type generally described above.

2. Discussion of the Background Information

In a device of the type generally discussed above, and as discussed in, e.g., German Patent Application No. DE-A-44 20 242, a stripping strip extends transversely to a web run direction and is positioned across from one of two adjacent drying cylinders. The strip is mounted to swivel on a suction box arranged between both drying cylinders and a perforated deflection roll, and the suction box serves to suction the perforated deflection roll externally. During operation, the stripping strip, which is made of synthetic material or formed by a felt strip, is arranged radially to, and at a distance from, the one drying cylinder.

In German Patent Application DE 297 03 627, an outwardly-arched deflector is positioned against a web run direction in an inlet region of a vapor blow box arranged on an outer periphery of a press roll. A fibrous pulp web and a felt belt are guided over the press roll. Due to the deflector arranged at a distance from the fibrous pulp web, the bordering air layer is deflected at least in part to the exterior wall of the vapor blow box, via which the deflected air is led away.

SUMMARY OF THE INVENTION

The present invention provides a device of the type generally discussed above having a sealing device that substantially guarantees an optimal impermeability for entrained air, especially at higher operating speeds, and which is not sensitive to interfering matter, e.g., paper clots, etc. Further, a suitable sealing device for use in such devices is also provided.

The present invention, therefore, provides a device that includes a sealing device having a sealing disc (or strip or plate), that is either substantially straight or at least partially curved, that has a preferably elastic design and/or is arranged in a resilient, yielding position. In the sealing device of the present invention, the sealing disc may be adapted to be pressed against the fibrous pulp web or a support belt.

Because of the advantageous features of the present invention, a higher impermeability of the entrained air may be obtained in comparison to the wool-felt and air-knife seals of the prior art. In this regard, potential functional impairments are practically eliminated, particularly at higher speeds. Due to the elastic sealing, interfering matter that may arise, e.g., paper clots, may be admitted without any damage or without a loss of impermeability.

The press force is preferably adjustable. In addition or alternatively, a device for automatic subsequent adjustment of the press force may also be provided. Thus, an optimal operation or an optimal sealing is substantially guaranteed, regardless of the respective operational requirements.

With an embodiment in accordance with an exemplary embodiment of the present invention, the sealing disc extends transversely to the web run direction.

The sealing disc can be composed of, e.g., metal, synthetic material, fiber-reinforced synthetic material, or composite material.

It may be particularly advantageous if the sealing disc is positioned so that it can swivel. In this manner, the sealing disc can swivelled away from the support face concerned, e.g., in order to unimpededly pull a new support belt into place.

In an expedient, practical embodiment, the sealing disc may be fastened to a swivel mounting from which it preferably can be removed. The sealing device or its sealing disc can thus be exchanged easily and quickly, should the need arise.

In embodiments that are preferred in practice, the sealing disc can be pressed, e.g., mechanically, pneumatically, and/or hydraulically. In this manner, a mechanical pressing of the sealing disc may be provided, e.g., via at least one rod, at least one press screw, and at least one spring or something device. In the event of a pneumatic and/or hydraulic pressing, the sealing disc may be imparted upon by at least one cylinder/piston unit.

The sealing device may be positioned, e.g., in an inlet region of a vapor blow box. In an expedient, practical embodiment, it may be positioned in the inlet region of a vapor blow box located on an exterior periphery of a press roll, over which the fibrous pulp web, and, if appropriate, the support belt is guided.

In this arrangement, the sealing device is expediently mounted on the vapor blow box or positioned so that it may swivel.

The sealing unit can be positioned, e.g., in a run-off area of a drying cylinder, i.e., where the fibrous pulp web and a support belt run off the drying cylinder to be subsequently guided to a suctioned, perforated, and/or grooved deflection roll associated with an exterior suction box.

The sealing device may be preferably disposed in front of the run-off area, i.e., relative to the web run direction.

If a sealing device is associated with such a suction box, it can then be mounted on the suction box, or positioned to swivel. Even when using other ventilation devices, the sealing device may be mounted on the ventilation device utilized.

If the fibrous pulp web and, if appropriate, at least one support belt is guided over a curved face, e.g., formed by a press roll, a drying cylinder, etc., then the sealing disc of the sealing device may be positioned to lie on a side of the fibrous pulp web located opposite the support face, i.e., the non-contacting surface, at least substantially tangential to the fibrous pulp web or the respective support belt.

In an expedient, practical embodiment, the sealing disc may be positioned to lie adjacent to a peripheral region that extends transverse to the web run direction of the fibrous pulp web or the respective support belt, while preferably being positioned in an area of its opposing edge, so that it can swivel. Thus, it is preferable if at least the peripheral region of the pressed sealing disc lying adjacent to the fibrous pulp web or to the respective support belt is arched in the press or swivel plane.

The sealing device in accordance with the present invention may include a sealing element having an elastic design and/or a resilient, yielding position. Additional devices may be provided to hold the sealing element at least at a minimum distance from the web or the support belt, if the web or the support belt has reached an operating speed that can be predetermined. A sealing device of this type may be used, e.g., in a device of the type discussed previously.

An inlet nip may be preferably formed between the sealing element and the web or the support belt.

With a sealing device of this kind, a dynamic sealing can also be obtained, which, e.g., is also suitable for stabilizers. At increasing speeds, the sealing element may be thereby lifted by a portion of the bordering air layer, so that, at least during normal operations, a contactless sealing occurs. In this manner, wear is substantially avoided. In any event, a smaller air flow volume is let through, which is advantageous, and the main flow may be blocked off. From the outset, it is generally possible to keep the sealing element at a minimal distance from the web or the support belt.

A dynamic sealing can be advantageously achieved via the elastic design and/or resilient, yielding position of the sealing disc. Also, simply an elastic design of the sealing element can be provided. Alternatively or additionally, the sealing element can be placed in a resilient, yielding arrangement. If the sealing element is in a resilient, yielding position, then it can be formed to be of a relatively rigid design, that, for the most part, provides the required yielding through resilient positioning. Alternatively or additionally, auxiliary devices may be utilized to keep the sealing element at least at a minimal distance from the web or the support belt, if the web or the support belt has achieved an operating speed that can be pre-determined.

At a standstill and at low speeds, e.g., during a running-up, the sealing element, in the event that a support belt such as a drying screen (sieve) is used, can come into contact with the reverse side of the support belt. The contact occurs, if appropriate, only for a short time. During operation, a part of the boundary air layer lifts the sealing disc, which is preferably flexible and/or in a resilient, yielding position. Due to the seal being achieved without any contact, wear by friction cannot arise. The boundary air layer entrained by the support belt is for the most removed or stripped away, so that a small portion of the bordering air flow arrives in the chamber to be evacuated. If, during a breakdown, a paper clot or a so-called "paper sausage" goes through the machine, then the sealing element, which is of an elastic design and/or positioned in a resilient, yielding manner, gives way.

The present invention is directed to a device for treating a fibrous pulp web that includes at least one support face, which is one of moving and stationary. The fibrous pulp web may be guided over the at least one support face. The device also includes at least one sealing device positioned on a side of the fibrous pulp web facing away from the at least one support face to strip at least a majority of a bordering air layer that entrained by the fibrous pulp web. The at least one sealing device may include a sealing disc that is one of substantially straight and at least partially curved, and that is at least one of elastically formed and resiliently mounted.

In accordance with another feature of the present invention, the sealing disc may be adapted to be pressed against the fibrous pulp web. Further, the pressing force of the sealing disc against the fibrous pulp web is adjustable.

In accordance with another feature of the present invention, the device further includes a device for automatic, subsequent adjustment of the pressing force of the sealing disc against the fibrous pulp web.

In accordance with another feature of the present invention, the sealing disc extends transversely to a web run direction.

In accordance with still another feature of the present invention, the sealing disc may be composed of one of metal, synthetic material, fiber-reinforced synthetic material and a composite material.

In accordance with still another feature of the present invention, the sealing disc may be mounted for swiveling movement. Further, the device includes a mounting element removably couplable to the sealing disc, and the mounting element may be mounted for swiveling movement.

In accordance with another feature of the present invention, the device also includes a device that to press the sealing disc. The mechanical pressing device may include at least one rod, at least one pressing screw, and at least one spring.

In accordance with a further feature of the present invention, the device includes a device that at least one of pneumatically and hydraulically presses the sealing disc. The at least one of the pneumatic and hydraulic device may include at least one cylinder/piston unit and the sealing disc may be coupled to the at least one cylinder/piston unit.

In accordance with a still further feature of the present invention, a ventilation device may be located in one of a press section and a dryer section and the sealing device may be located in a region of the ventilation device. The ventilation device may include at least one of a vapor blow box, a suction box, a stabilizer, and ventilation installations. Alternatively, the ventilation device includes a vapor blow box and the sealing device may be located in an inlet region of the vapor blow-box. Further, the sealing device may be positioned on an outer periphery of a press roll over which the fibrous pulp web is guided. Still further, the sealing device is mounted on the vapor blow-box.

In accordance with still another feature of the present invention, the device including a deflection roll composed of at least one of a suctioned, perforated, and grooved roll associated with an exterior suction box and the sealing device may be positioned in a region of a dryer cylinder in which the fibrous pulp web runs off the dryer cylinder to the deflection roll. Further, the sealing device may be positioned prior to the run-off region in the web run direction.

In accordance with a still further feature of the present invention, the support face may include a curved support face formed by one of a press roll and a dryer cylinder and the sealing disc may be positioned at least substantially tangential to the curved support face.

In accordance with still another feature of the present invention, the sealing disc may have an edge region extending transverse to the web run direction and lying on the fibrous pulp web and an opposite edge region mounted for swiveling movement. Further, at least the edge region of the sealing disc that lies against the fibrous pulp web may be curved in the press plane.

In accordance with a further feature of the present invention, the device may include at least one support belt for guiding the fibrous pulp web over the support face. Further, the at least one support belt may be composed by a dryer screen. Still further, the at least one support belt may be composed of at least one of a draining belt, a press belt, and a screen belt. Further still, the at least one support belt may be radially outside of the fibrous pulp web and the at least one sealing device may be adapted to be pressed against the at least one support belt.

In accordance with another feature of the present invention, the at least one sealing device may include a support plate having a first and second end, and the sealing disc may have a first and second end and being arched such that the first end of the sealing disc extends around the first end of the support plate. Further, the second end of the sealing disc and the second end of the support plate may be mounted together. Further, the device may include a ventilation device coupled to a suction roll so that the fibrous pulp web is guided over the suction roll and the second end of the sealing disc and the second end of the support plate may be mounted together on the ventilation device. Still further, the first end of the sealing disc may be arched in the web travel direction. Further still, the first end of the sealing disc may maintain an opening between the fibrous pulp web and a surface of the first end facing the fibrous pulp web.

The present invention is directed to a sealing device adapted to be positioned a region between a ventilation device and a fibrous pulp web. The sealing device includes at least one sealing element adapted to be located between the web and the ventilation device to strip at least a majority of bordering air layer that is entrained via the fibrous pulp web. The at least one sealing element may have at least one of an elastic design and a resilient arrangement. The sealing device may also include a positioning device that positions the at least one sealing element to maintain a minimum distance from the web once a predetermined operating speed is attained.

In accordance with another feature of the present invention, the minimum distance may be between approximately 0.5 and 1.5 mm.

In accordance with another feature of the present invention, the positioning device may have an adjustment device to adjust the minimum distance.

In accordance with a further feature of the present invention, the sealing element may include a sealing disc that is one of substantially straight and at least partially curved.

In accordance with still another feature of the present invention, the sealing device further including an inlet nip formed between the sealing element and the web.

In accordance with yet another feature of the present invention, the sealing device further including at least one support belt for guiding the fibrous pulp web over the support face, the fibrous pulp web being located between the at least one support belt and the support face. The at least one support belt may be composed of at least one of a draining belt, a press belt, and a screen belt. Further, the positioning device further positions the at least one sealing element to maintain a minimum distance from the at least one support belt once a predetermined operating speed is attained.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
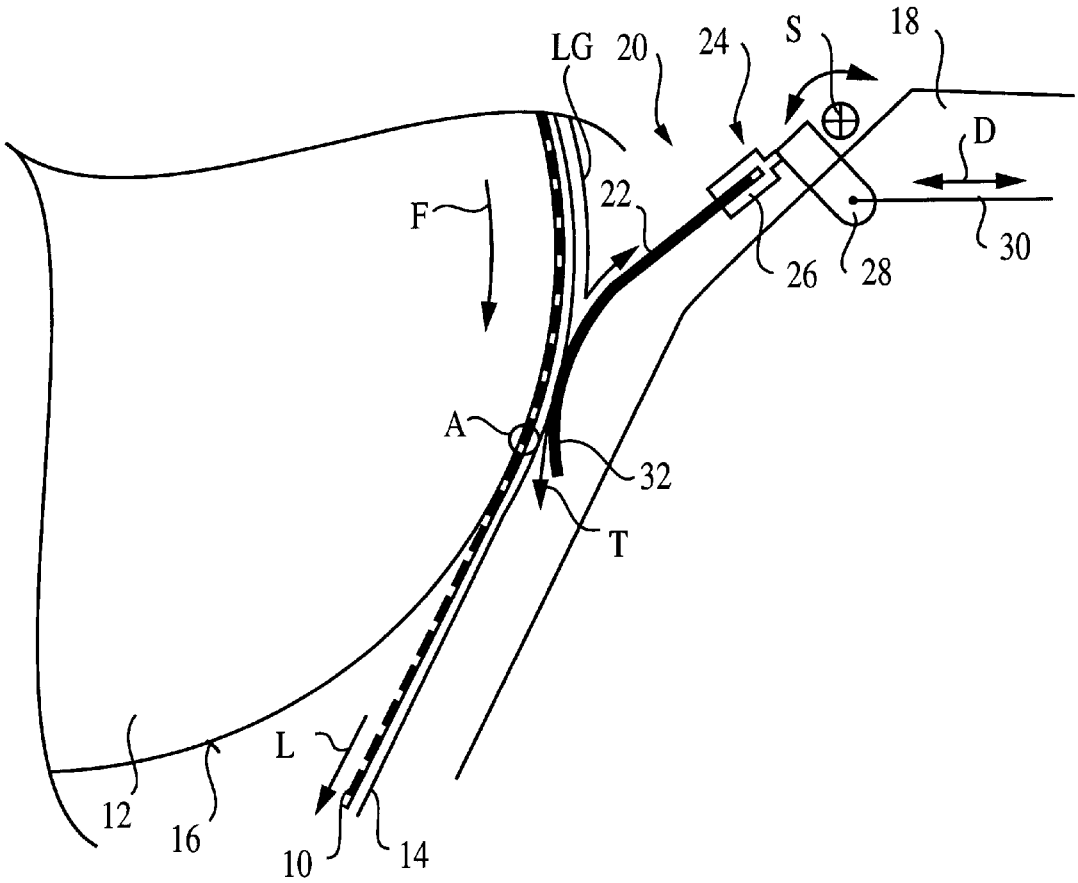
FIG. 1 illustrates a first embodiment of a sealing device in combination with a machine for treating a fibrous pulp web.

The device, according to the present invention, is provided to treat a fibrous pulp web 10, e.g., a paper and/or cardboard web. In FIG. 1, a drying cylinder 12 of a partially depicted drying section rotates in a direction of arrow F. A support belt 14, e.g., a drying screen (sieve), may be guided with the fibrous pulp web 10 over dryer cylinder 12.

Support belt 14 and fibrous pulp web 10 may be guided to a run-off area A of dryer cylinder 12 along support face 16 formed by the exterior peripheral face of drying cylinder 12. To be guided in a web run direction L, support belt 14 and fibrous pulp web 10 may be guided to a deflection roll (not shown), e.g., a suctioned, perforated and/or grooved deflection roll, associated with an exterior suction box 18, which is partially shown.

A sealing device 20 may be positioned on a side of fibrous pulp web 10 and support belt 14 that is turned away from (opposite) support face 16. In the present embodiment, sealing device 20 is positioned prior to run-off area A in web run direction L. In the exemplary embodiment, sealing device 20 serves to strip off at least the majority of the bordering air layer swept in (entrained) by support belt 14. As shown in FIG. 1, fibrous pulp web 10 may be arranged between support belt 14 and dryer cylinder 12, so that, at least at a standstill and at low speeds, fibrous pulp web 10 comes into direct contact with dryer cylinder 12.

Sealing device 20 includes a sealing disc or plate 22 which may be, e.g., substantially straight or at least partially curved, and which can be pressed against support belt 14. Sealing disc 22 may be, e.g., of an elastic design and/or may be pressed against support belt 14 in a resilient, yielding manner.

Sealing disc 22 extends transverse to web run direction L, and may be composed of, e.g., metal, synthetic material, fiber-reinforced synthetic material or a composite material.

As illustrated in FIG. 1, sealing disc 22 may be fastened on its upper edge, which extends in web run direction L, to a mounting 24 in a detachable manner. Further, mounting 24 may be mounted on suction box 18 for movement, e.g., swivelling, about an axis S that is transverse to web run direction L.

The upper edge of sealing disc 22 may be located, in a detachable manner, in a forked holding fixture 26 of swivel mounting 24.

Furthermore, swiveling mounting 24 may include a clip or bracket 28 coupled to a free end of a rod 30 that is movable in the two directions indicated by double arrow D to adjust the position of sealing disc 22 around swivel axis S, i.e., to press against support belt 14 or to remove it from support belt 14.

As can be seen from FIG. 1, sealing disc 22 includes an edge region 32 that freely extends transverse to web run direction L and lies adjacent to support belt 14. In this manner, a portion of sealing disc 22, in web run direction L, extends a bit in front of run-off region A. Edge region 32 lying adjacent to support belt 14 is, at least with a pressed sealing disc 22, arched in the depicted manner in the press or swivelling plane.

The press force is preferably adjustable. In addition, sealing device 22 is expediently designed, so that an automatic, and subsequent adjustment of this press force occurs.

In the present case, sealing device 20 substantially hinders a larger portion of the air swept in or entrained by support belt 14 from proceeding into a region of the externally suctioned deflection roll. In this manner, the energy required to create the pressure in suction box 18 may be held down.

During operation, a portion of a bordering air layer LG may lift sealing disc 22, which may be flexible and/or resiliently and yieldingly positioned, to further support an inlet nip formed between sealing disc 22 and support belt 14. As a result of the contactless sealing, substantially no frictional wear occurs. Bordering air layer LG that is swept in or entrained with support belt 14 may be, for the most part, stripped or peeled away so that only a small portion T of bordering air layer LG proceeds into the chamber to be evacuated. If, during a breakdown, a so-called paper clot or "paper sausage" goes through the machine, then sealing disc 22, which is of an elastic design and/or positioned in a resilient, yielding manner allows the clot to pass.

Figure 2:
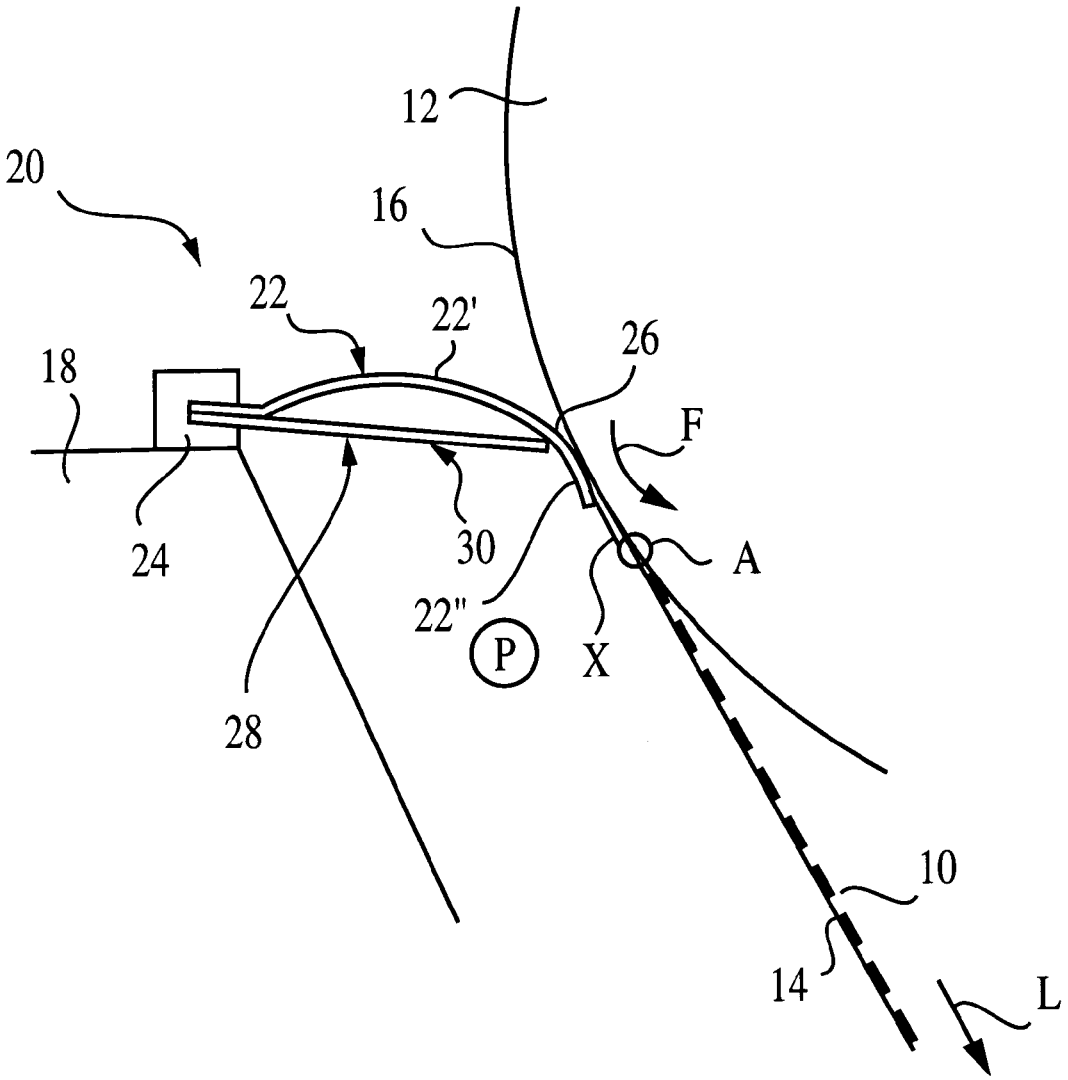
FIG. 2 illustrates a second embodiment of the sealing device in combination with a machine for treating the fibrous pulp web.

In FIG. 2, sealing device 20 includes a relatively elastic sealing disc 22, which is mounted on one end by mounting 24 provided on the suction box 18. The opposite (free) end of elastic sealing disc 22 may be positioned to face support belt 14 with a separation distance X between a facing surface of elastic sealing disc 22 and support face 16.

As seen in FIG. 2, sealing plate 22 may include a sealing disc portion 22' curved up from the end clamped into mounting 24 and arched upward so that a pressure side P in a region of suction box 18 is positioned within the arch formed by portion 22'. In a region of the free end of sealing plate 22', the free end is positioned toward support belt 14, which guides fibrous pulp web 10 over support face 16.

Due to a pressure differential prevailing between both sides of sealing disc 22, a flexing of sealing disc portion 22' between the mounted end of sealing disc 22 and a support point 26 around a rotation axis extending transversely to web run direction L at least counteracts an undesirable flexing or deflection of a sealing disc section 22" between support point 26 and the free end. In this manner, and particularly at higher pressure differentials, a maximum distance X between the sealing disc 22 and support belt 14 may be maintained, and not enlarged.

In the instant embodiment, relatively elastic sealing plate 22 may be supported by a stiffer support disc (plate) 38 positioned on pressure side P. Support disc 38 may be provided with ports 30 and one end may be clamped in mounting 24 with the mounted end of sealing disc portion 22'.

Support point 26 and, thus, the rotation axis formed in its vicinity, lie closer to the free end of sealing disc 22 than to the mounted end. Thus, due to the differential pressure during operation, a relatively large working area arises with sealing disc portion 22' and the flexing of the working area counteracts undesirable deviation of sealing disc section 22" adjacent to support belt 14. In this manner, even with greater pressure differentials, substantially no alteration of distance X occurs. Ports 30 provided in support disc 38 make certain that sealing disc section 22' lying between the mounted end and support point 26 is imparted with pressure in the require manner.

Further, sealing disc 22 is supported in the formation of the rotational axis extending transversely to web run direction L by a free end of support disc 38 that lies under it.

The distance to be maintained between sealing disc section 22" and support belt 14 can be adjusted. In addition, distance X can be given with an inoperative machine or at lower web running speeds. Generally, however, a dynamic sealing is also possible in which sealing disc section 22 is first lifted by a portion of the bordering air layer during the acceleration of the machine, i.e., with increasing web velocity. In this manner, the desired distance X may be, at the latest, adjusted once operational speed is attained. Wear can be avoided due to the contact-free sealing that occurs during operation.

In any event, sealing device 20 hinders a greater portion of the air that was entrained by support belt 14 from reaching the region of the externally suctioned deflection roll (not depicted), so that the pressure to be created in suction box 18 and, therewith, the expenditure of energy required for the creation of pressure can be kept down.

The bordering air layer that is entrained by support belt 14 is, for the most part, scraped off or stripped off, so that, at most, a small portion of the bordering air flow reaches the chamber to be evacuated. If, during a breakdown, a so-called paper clot or "paper sausage" goes through the device or the machine, then sealing disc section 22" of relatively elastic sealing plate 22 gives way.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE NUMERAL LIST

10 Fibrous pulp web
12 Drying cylinder
14 Support belt
16 Support face
18 Suction box
20 Sealing device
22 Sealing disc
22' Sealing disc portion

22" Sealing disc section
24 Mounting
26 Forked holding fixture
28 Clip
30 Rod
32 Edge region
38 Support disc
A Run-off region
D Double arrow
F Arrow
L Web run direction
S Swivel axis
LG Bordering air layer
T Small portion

What is claimed:

1. A device for treating a fibrous pulp web comprising:

at least one support face, which is one of moving and stationary, the fibrous pulp web being guided over the at least one support face;

at least one sealing device positioned on a side of the fibrous pulp web facing away from the at least one support face to strip at least a majority of a bordering air layer that is entrained by the fibrous pulp web;

the at least one sealing device comprising a sealing disc that is one of substantially straight and at least partially curved, and that is at least one of elastically formed and resiliently mounted; and at least one support belt for guiding the fibrous pulp web over the support face.

2. The device in accordance with claim 1, the sealing disc being adapted to be pressed against the fibrous pulp web.

3. The device in accordance with claim 2, wherein a pressing force of the sealing disc against the fibrous pulp web is adjustable.

4. The device in accordance with claim 1, further comprising a device for automatic, subsequent adjustment of a pressing force of the sealing disc against the fibrous pulp web.

5. The device in accordance with claim 1, the sealing disc extending transversely to a web run direction.

6. The device in accordance with claim 1, the sealing disc being composed of one of metal, synthetic material, fiber-reinforced synthetic material and a composite material.

7. The device in accordance with claim 1, the sealing disc being mounted for swiveling movement.

8. The device in accordance with claim 1, further comprising a device to mechanically press the sealing disc.

9. The device in accordance with claim 8, the mechanical pressing device comprising at least one rod, at least one pressing screw, and at least one spring.

10. The device in accordance with claim 1, further comprising a device to at least one of pneumatically and hydraulically press the sealing disc.

11. The device in accordance with claim 1, further comprising a ventilation device located in one of a press section and a dryer section; and the at least one sealing device being located in a region of the ventilation device.

12. The device in accordance with claim 11, the ventilation device comprising at least one of a vapor blow box, a suction box, a stabilizer, and ventilation installations.

13. The device in accordance with claim 11, the at least one sealing device being mounted on the ventilation device.

14. The device in accordance with claim 1, the support face comprising a curved support face formed by one of a press roll and a dryer cylinder; and the sealing disc being positioned at least substantially tangential to the curved support face.

15. The device in accordance with claim 1, the sealing disc having an edge region extending transverse to the web run direction and lying on the fibrous pulp web and an opposite edge region mounted for swiveling movement.

16. The device in accordance with claim 1, the at least one support belt being composed by a dryer screen.

17. The device in accordance with claim 1, the at least one support belt being composed of at least one of a draining belt, a press belt, and a screen belt.

18. The device in accordance with claim 1, the at least one support belt being radially outside of the fibrous pulp web; and the at least one sealing device being adapted to be pressed against the at least one support belt.

19. A device for treating a fibrous pulp web comprising:

at least one support face, which is one of moving and stationary, the fibrous pulp web being guided over the at least one support face;

at least one sealing device positioned on a side of the fibrous pulp web facing away from the at least one support face to strip at least a majority of a bordering air layer that is entrained by the fibrous pulp web;

the at least one sealing device comprising a sealing disc that is one of substantially straight and at least partially curved, and that is at least one of elastically formed and resiliently mounted;

the sealing disc being mounted for swiveling movement;

a mounting element removably couplable to the sealing disc; and the mounting element being mounted for swiveling movement.

20. A device for treating a fibrous pulp web comprising:

at least one support face, which is one of moving and stationary, the fibrous pulp web being guided over the at least one support face;

at least one sealing device positioned on a side of the fibrous pulp web facing away from the at least one support face to strip at least a majority of a bordering air layer that is entrained by the fibrous pulp web;

the at least one sealing device comprising a sealing disc that is one of substantially straight and at least partially curved, and that is at least one of elastically formed and resiliently mounted;

a device to at least one of pneumatically and hydraulically press the sealing disc;

the at least one of the pneumatic and hydraulic device comprising at least one cylinder/piston unit; and the sealing disc being coupled to the at least one cylinder/piston unit.

21. A device for treating a fibrous pulp web comprising:

at least one support face, which is one of moving and stationary, the fibrous pulp web being guided over the at least one support face;

at least one sealing device positioned on a side of the fibrous pulp web facing away from the at least one support face to strip at least a majority of a bordering air layer that is entrained by the fibrous pulp web;

the at least one sealing device comprising a sealing disc that is one of substantially straight and at least partially curved, and that is at least one of elastically formed and resiliently mounted;

a ventilation device located in one of a press section and a dryer section;

the at least one sealing device being located in a region of the ventilation device;

the ventilation device comprising a vapor blow box; and the at least one sealing device being located in an inlet region of the vapor blow-box.

22. The device in accordance with claim 21, the at least one sealing device being positioned on an outer periphery of a press roll over which the fibrous pulp web is guided.

23. The device in accordance with claim 21, wherein the at least one sealing device is mounted on the vapor blow-box.

24. A device for treating a fibrous pulp web comprising:

at least one support face, which is one of moving and stationary, the fibrous pulp web being guided over the at least one support face;

at least one sealing device positioned on a side of the fibrous pulp web facing away from the at least one support face to strip at least a majority of a bordering air layer that is entrained by the fibrous pulp web;

the at least one sealing device comprising a sealing disc that is one of substantially straight and at least partially curved, and that is at least one of elastically formed and resiliently mounted;

a deflection roll composed of at least one of a suctioned, perforated, and grooved roll associated with an exterior suction box; and the sealing device being positioned in a region of a dryer cylinder in which the fibrous pulp web runs off the dryer cylinder to the deflection roll.

25. The device in accordance with claim 24, the sealing device being positioned prior to the run-off region in the web run direction.

26. A device for treating a fibrous pulp web comprising:

at least one support face, which is one of moving and stationary, the fibrous pulp web being guided over the at least one support face;

at least one sealing device positioned on a side of the fibrous pulp web facing away from the at least one support face to strip at least a majority of a bordering air layer that is entrained by the fibrous pulp web;

the at least one sealing device comprising a sealing disc that is one of substantially straight and at least partially curved, and that is at least one of elastically formed and resiliently mounted;

the sealing disc having an edge region extending transverse to the web run direction and lying on the fibrous pulp web and an opposite edge region mounted for swiveling movement; and at least the edge region of the sealing disc that lies against the fibrous pulp web is curved in the press plane.

27. A device for treating a fibrous pulp web comprising:

at least one support face, which is one of moving and stationary, the fibrous pulp web being guided over the at least one support face;

at least one sealing device positioned on a side of the fibrous pulp web facing away from the at least one support face to strip at least a majority of a bordering air layer that is entrained by the fibrous pulp web;

the at least one sealing device comprising a sealing disc that is one of substantially straight and at least partially curved, and that is at least one of elastically formed and resiliently mounted; and the at least one sealing device further comprising:

a support plate having a first and second end; and the sealing disc having a first and second end and being arched such that the first end of the sealing disc extends around the first end of the support plate.

28. The device in accordance with claim 27, the second end of the sealing disc and the second end of the support plate being mounted together.

29. The device in accordance with claim 27, further comprising a ventilation device coupled to a suction roll, the fibrous pulp web being guided over the suction roll; and the second end of the sealing disc and the second end of the support plate being mounted together on the ventilation device.

30. The device in accordance with claim 27, the first end of the sealing disc being arched in the web travel direction.

31. The device in accordance with claim 30, the first end of the sealing disc maintaining an opening between the fibrous pulp web and a surface of the first end facing the fibrous pulp web.

32. A sealing device adapted to be positioned in a region between a ventilation device and a fibrous pulp web comprising:

at least one sealing element adapted to be located between the web and the ventilation device to strip at least a majority of bordering air layer that is entrained via the fibrous pulp web;

the at least one sealing element having at least one of an elastic design and a resilient arrangement; and a positioning device that positions the at least one sealing element to maintain a minimum distance from the web once a predetermined operating speed is attained.

33. The sealing device in accordance with claim 32, the sealing element comprising a sealing disc that is one of substantially straight and at least partially curved.

34. The sealing device in accordance with claim 32, further comprising at least one support belt for guiding the fibrous pulp web over the support face, the fibrous pulp web being located between the at least one support belt and the support face.

35. The sealing device in accordance with claim 34, the at least one support belt being composed of at least one of a draining belt, a press belt, and a screen belt.

36. A sealing device adapted to be positioned in a region between a ventilation device and a fibrous pulp web comprising:

at least one sealing element adapted to be located between the web and the ventilation device to strip at least a majority of bordering air layer that is entrained via the fibrous pulp web;

the at least one sealing element having at least one of an elastic design and a resilient arrangement;

a positioning device that positions the at least one sealing element to maintain a minimum distance from the web once a predetermined operating speed is attained; and the minimum distance being between approximately 0.5 and 1.5 mm.

37. A sealing device adapted to be positioned in a region between a ventilation device and a fibrous pulp web comprising:

at least one sealing element adapted to be located between the web and the ventilation device to strip at least a majority of bordering air layer that is entrained via the fibrous pulp web;

the at least one sealing element having at least one of an elastic design and a resilient arrangement;

a positioning device that positions the at least one sealing element to maintain a minimum distance from the web once a predetermined operating speed is attained; and the positioning device having an adjustment device to adjust the minimum distance.

38. A sealing device adapted to be positioned in a region between a ventilation device and a fibrous pulp web comprising:

at least one sealing element adapted to be located between the web and the ventilation device to strip at least a majority of bordering air layer that is entrained via the fibrous pulp web;

the at least one sealing element having at least one of an elastic design and a resilient arrangement;

a positioning device that positions the at least one sealing element to maintain a minimum distance from the web once a predetermined operating speed is attained; and an inlet nip formed between the sealing element and the web.

39. A sealing device adapted to be positioned in a region between a ventilation device and a fibrous pulp web comprising:

at least one sealing element adapted to be located between the web and the ventilation device to strip at least a majority of bordering air layer that is entrained via the fibrous pulp web;

the at least one sealing element having at least one of an elastic design and a resilient arrangement;

a positioning device that positions the at least one sealing element to maintain a minimum distance from the web once a predetermined operating speed is attained;

at least one support belt for guiding the fibrous pulp web over the support face, the fibrous pulp web being located between the at least one support belt and the support face; and the positioning device further positions the at least one sealing element to maintain a minimum distance from the at least one support belt once a predetermined operating speed is attained.

* * * * *